US009731802B2

(12) United States Patent
Ketterman et al.

(10) Patent No.: US 9,731,802 B2
(45) **Date of Patent: *Aug. 15, 2017**

(54) FIN FOR OSCILLATING FOIL PROPULSION SYSTEM

(71) Applicant: Hobie Cat Company, a Missouri Corporation, Oceanside, CA (US)

(72) Inventors: Gregory Scott Ketterman, Oceanside, CA (US); James Taylor Czarnowski, Fallbrook, CA (US)

(73) Assignee: Hobie Cat Company, Oceanside, CA (US)

( * ) Notice: Subject to any disclaimer, the term of this patent is extended or adjusted under 35 U.S.C. 154(b) by 99 days.

This patent is subject to a terminal disclaimer.

(21) Appl. No.: 14/882,808

(22) Filed: Oct. 14, 2015

(65) Prior Publication Data

US 2016/0052610 A1 Feb. 25, 2016

Related U.S. Application Data

(63) Continuation of application No. 12/583,285, filed on Aug. 17, 2009, now Pat. No. 9,540,086, which is a (Continued)

(51) Int. Cl.
*B63H 1/30* (2006.01)
*B63H 1/36* (2006.01)
(Continued)

(52) U.S. Cl.
CPC ..... *B63H 1/30* (2013.01); *B63H 1/36* (2013.01); *B63H 16/12* (2013.01)

(58) Field of Classification Search
CPC ... B63H 1/30; B63H 1/32; B63H 1/36; B63H 16/12; B63H 16/18
(Continued)

(56) References Cited

U.S. PATENT DOCUMENTS 35,451 A 6/1862 Johnson
2,173,415 A 9/1939 Hill, Jr.
(Continued)

FOREIGN PATENT DOCUMENTS

DE 3001502 7/1981
DE 3301943 A1 7/1984
(Continued)

OTHER PUBLICATIONS

Howe, "Penguin Power Bids to Challenge the Propeller", The Boston Globe, May 13, 1997, pp. C1, C2.

*Primary Examiner* — Ajay Vasudeva
(74) *Attorney, Agent, or Firm* — Joseph E. Mueth

(57) ABSTRACT

A watercraft having propulsion means extending below the water line comprising a pair of flexible fins each adapted to oscillate through an arcurate path in a generally transverse direction across the central longitudinal dimension of the watercraft. As input force is applied, the fins twist to form an angle of attack for providing forward thrust while moving in both directions along the arcurate path. Each of the fins have a generally squared off top and preferably an outer area of harder rubber than the inner area. Each of the fins can be adjusted at the trailing edge to provide adjustable tensioning of the trailing edge.

6 Claims, 8 Drawing Sheets

Related U.S. Application Data continuation of application No. 11/499,179, filed on Aug. 3, 2006, now Pat. No. 7,637,791.

(60) Provisional application No. 60/706,722, filed on Aug. 8, 2005.

(51) Int. Cl.
*B63H 16/08* (2006.01)
*B63H 16/18* (2006.01)

(58) Field of Classification Search
USPC ..... 440/13–22, 25; 416/79, 81
See application file for complete search history.

(56) References Cited

U.S. PATENT DOCUMENTS

| | | | | |
|---|---|---|---|---|
| 2,286,914 | A | 6/1942 | Knapp | |
| 2,873,713 | A | 12/1955 | Baastrup | |
| 2,948,255 | A | 8/1960 | Sbrana | |
| 3,032,001 | A | 5/1962 | Kiker, Jr. | |
| 3,095,850 | A | 7/1963 | Stolzer | |
| 3,695,211 | A | 10/1972 | Gross | |
| 3,845,733 | A * | 11/1974 | Jackman | B63H 16/08 416/81 |
| 4,172,427 | A | 10/1979 | Kindred | |
| 4,318,700 | A | 3/1982 | Price | |
| 4,474,502 | A | 10/1984 | Daoud | |
| 4,490,119 | A | 12/1984 | Young | |
| 4,511,338 | A | 4/1985 | Fanelli | |
| 4,635,577 | A | 1/1987 | Palmquist | |
| 4,936,802 | A | 6/1990 | Ueno | |
| 4,960,396 | A | 10/1990 | Stolzer | |
| 5,183,422 | A | 2/1993 | Guiboche | |
| 5,194,024 | A | 3/1993 | Shiraki | |
| 5,460,551 | A | 10/1995 | Beres | |
| 6,022,249 | A | 2/2000 | Ketterman et al. | |
| 6,050,868 | A | 4/2000 | McCarthy | |
| 6,755,706 | B1 | 6/2004 | Lin | |
| 7,637,791 | B2 | 12/2009 | Ketterman et al. | |
| 9,540,086 | B2 * | 1/2017 | Ketterman | B63H 1/36 |

FOREIGN PATENT DOCUMENTS

| | | | |
|---|---|---|---|
| DE | 3431660 | A1 | 3/1986 |
| GB | 452719 | | 8/1936 |
| GB | 1192917 | | 5/1970 |
| GB | 2049594 | A | 12/1980 |
| JP | 52-33290 | | 3/1977 |
| JP | 1-156194 | | 6/1989 |
| JP | 1-144198 | | 10/1989 |
| JP | 3-035897 | | 8/1991 |
| JP | 2007-186046 | A | 7/2007 |

* cited by examiner

FIN FOR OSCILLATING FOIL PROPULSION SYSTEM

This patent is a continuation of U.S. patent application Ser. No. 12/583,285, filed Aug. 17, 2009, which is a continuation of U.S. patent application Ser. No. 11/499,179, filed Aug. 3, 2006, which claims the filing date of U.S. Provisional Patent Application Ser. No. 60/706,722, filed Aug. 8, 2005, the disclosures of which are incorporated herein by reference.

FIELD OF INVENTION

The present invention relates generally to the means of propelling a vessel and more specifically it relates to the design of a thrust producing oscillating fin.

BACKGROUND OF THE INVENTION

Oscillating fin propulsion has been used to produce efficient propulsion. This technology appears in U.S. Pat. No. 6,022,249, the text and drawings of which are expressly incorporated herein by reference, which discloses a novel water craft, such as a kayak, which typically include a hull with a keel, having propulsion means extending below the water line. The propulsion means comprises a pair of flappers each having a leading edge and a trailing edge and adapted to oscillate through an arcuate path in a generally transverse direction with respect to the central longitudinal dimension of the watercraft. Foot operated pedals are operatively associated with the propulsion means for applying input force to the propulsion means. The propulsion means includes a pair of fins or flappers which twist to form an angle of attack for providing forward thrust with respect to the longitudinal dimension of the watercraft while moving in both directions along the arcuate path.

SUMMARY OF THE INVENTION

Briefly, this invention comprises in a watercraft having propulsion means extending below the water line comprising a pair of flexible fins each having a leading edge and a trailing edge and adapted to oscillate through an arcuate path in a generally transverse direction with respect to the central longitudinal dimension of said watercraft, and means operatively associated with said propulsion means for applying input force to said propulsion means whereby as input force is applied said flexible fins can twist to form an angle of attack for providing forward thrust with respect to the longitudinal dimension of the watercraft while moving in both directions along said arcuate path;

the improvement wherein each of said fins is provided with essentially square top ends to provide enhanced fin twist and more efficient propulsion.

In another aspect, this invention comprises in a watercraft having propulsion means extending below the water line comprising a pair of flexible fins each having a leading edge and a trailing edge and adapted to oscillate through an arcuate path in a generally transverse direction with respect to the central longitudinal dimension of said watercraft, and means operatively associated with said propulsion means for applying input force to said propulsion means whereby as input force is applied said flexible fins can twist to form an angle of attack for providing forward thrust with respect to the longitudinal dimension of the watercraft while moving in both directions along said arcuate path;

the improvement wherein each of said fins has generally square top and a generally peripheral area which is a harder, less flexible rubber than the inner area whereby the cordwise stiffness of the fin increases in the direction of the trailing edge.

The inner area is preferably of a sawtooth configuration.

Still further, this invention comprises in a watercraft having propulsion means extending below the water line comprising a pair of flexible fins each having a leading edge and a trailing edge and adapted to oscillate through an arcuate path in a generally transverse direction with respect to the central longitudinal dimension of said watercraft, and means operatively associated with said propulsion means for applying input force to said propulsion means whereby as input force is applied said flexible fins can twist to form an angle of attack for providing forward thrust with respect to the longitudinal dimension of the watercraft while moving in both directions along said arcuate path;

the further improvement wherein each of said fins is provided with means at its trailing edge to provide adjustable tensioning of the trailing edge.

This invention further comprises in a watercraft having propulsion means extending below the water line comprising a pair of flexible fins each having a leading edge and a trailing edge and adapted to oscillate through an arcuate path in a generally transverse direction with respect to the central longitudinal dimension of said watercraft, and means operatively associated with said propulsion means for applying input force to said propulsion means whereby as input force is applied said flexible fins can twist to form an angle of attack for providing forward thrust with respect to the longitudinal dimension of the watercraft while moving in both directions along said arcuate path;

the more specific improvement wherein each of said fins is provided with threaded means at the clew of its trailing edge to provide adjustable tensioning of the trailing edge.

The present invention pertains to an improved pedaled kayak propelled by the action of two transversely oscillating fins or sails. As the force on the pedals is increased, the less restrained end of the fins or sail twists to assume a propeller like shape. As the fins or sails oscillate, they change pitch or shape upon reaching the end of their arcuate movement, viz, when they simultaneously reverse direction of movement at the opposite ends of their arcuate pathway. This sail action is somewhat similar to what happens when tacking in a sailboat in that the sails exert, in both of their directions of movement, a forward thrust component.

The kayak has a generally elongated hull having a cockpit, a seat located such that the hip of the user is substantially fully below the upper deck of the kayak. The cockpit also contains a set of pedals adapted to be pushed, first one and then the other, by the user's feet. The hull is also provided with a rudder and tiller.

The pedals are operatively connected by pedal shafts to the propulsion means which extends through two vertically disposed compartments in the center of the bottom of hull, the upper compartment being somewhat larger than the lower compartment. The bottom of the lower compartment has an opening.

The fins of this invention are of unique structure. While the maximum spanwise length from the base to the top of the fin and the cordwise length from the leading edge to the trailing edge is similar to prior fins, the configuration and composition by area are significantly different. The fins of this invention have essentially square top ends as contrasted with the more nearly triangular top ends of prior fins. This results in a somewhat greater average spanwise length. Thus, in fins of this invention have increased cord area near and at the top end of the fin.

The fin is oscillated from a pivot point near the base of its mast. This motion induces a velocity field perpendicular to the fin that increases in strength proportional to the distance from the base. In order to achieve efficient lift (avoid stall and operate near optimal Lift Coefficient), the fin must twist in a manner proportional to the increased perpendicular flow speed. It has been found that having a wider cord length at the tip, (essentially square-top design) creates the desired fin twist and thus more efficient propulsion.

Optimized cord-wise flexibility of the fin for more efficient lift generation. Just as proper cord-wise hydrodynamic foil shape is important on an airplane wing, or the sail shape on a sailboat, having an efficient lifting surface is necessary for the fin to operate efficiently. Lifting foils typically have a cross-section where the maximum thickness, (or in the case of a sail, maximum outward curve) is located about ⅓ of the local cord length back from the leading edge. Like a sail, and unlike most commercial foil sections, the fin of U.S. Pat. No. 6,022,249 is flexible. This flexibility requires that the fin stiffness and shape, combined with the surrounding flow-field, determine the shape of the foil during operation.

In the present invention, an innovative geometry and multiple material molding process creates a cord-wise flexibility that results in an efficient fin shape during operation. In the fins of this invention, the cord-wise stiffness of the fin increases in the aft direction, that is, in the direction of the trailing edge, despite the overall thickness of the fin gradually decreasing in the direction of the trailing edge due to the peripheral stiffer material used in the sub-mold as further described hereinbelow. We have found that the sawtooth pattern increases the cordwise stiffness near the trailing edge while minimizing spanwise stiffness. This construction significantly enhances performance.

The reference to "fin" herein is generally synonymous with flapper or foil.

The present invention provides an adjustable "mainsheet", that is, fin tensioning device to allow for customized peddling resistance for various operators and optimized hydrodynamic performance for different vessel lengths. The fin is analogous to a sailboat sail in several ways. One way is the attachment and tension of the corner of the fin located aft and near the base. The tension on this corner affects the shape and therefore performance of the fin much like the mainsheet tension does on a sail. Increasing the tension of this corner (mainsheet tension) increases the angle of attack of the fin meeting the water which creates more lift and more resistance. The mainsheet adjusting device located on the aft corner of the fin is easily adjusted by the user. Larger, stronger operators, operators that wish to peddle at a slower cadence, or fins used on longer, faster vessels may prefer to operate with more mainsheet tension. Those who prefer to peddle at a higher frequency, less powerful peddlers, or operators of shorter and slower boats may prefer less mainsheet tension.

DESCRIPTION OF THE PREFERRED EMBODIMENT

Figure 1:
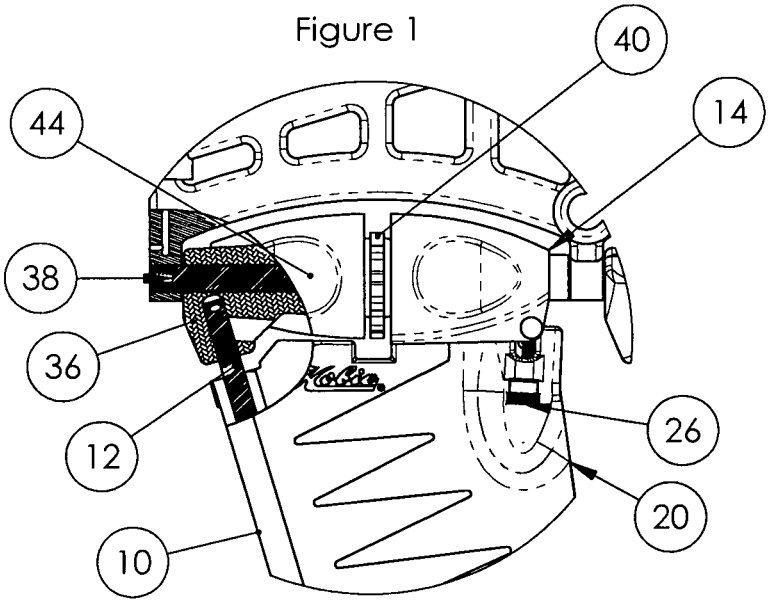
FIG. 1 is an assembly view in partial cutaway showing a partial view of the fin and its assembly with the fin drive assembly.

The oscillating fin 10 has a mast 12 on its or in proximity to its leading edge 13. The base is affixed to and carried by base or clew member 14. The top of the fin 10 has two squared off, nearly right angled, corners 16 and 18.

The trailing edge 20 of the fin 10 has an adjustable tensioning means 22 at the base or clew 14 of the fin 10. The tensioning means comprises threaded lead screw 24 rigidly attached to the base 14. A thumb nut 26 is threadably received on lead screw 24.

The lead screw 24 and thumb nut 26 set in cutout 28 in the fin 10. The exposed free face or end 30 of thumb nut 26 and the cutout 28 are such that as the thumb nut 26 is digitally rotated on the lead screw 24, the exposed face or end 30 of thumb nut 26 comes into abutting contact with the exposed edge 31 of the cutout 28 in fin 10. As the thumb nut 26 is then further advanced on the lead screw 24 in the direction of the top of the fin 10, the face 30 of thumb nut 26 exerts increased pressure on the exposed edge 31 of cutout 28. The tension in the trailing edge 20 is thereby increased. It will be understood then that as the thumb nut 26 is turned in the opposite direction so that it no longer applies force or pressure to the edge 31 of the cutout 28, the tension in the trailing edge 20 of fin 10 is lessened so that the trailing edge of fin 10 becomes more flaccid.

The body of the fin 10 presently has two distinct areas. The generally peripheral area is an undermolded area 32 which is pre-formed of a harder, stiffer, less flexible rubber, preferably have a Shore A Hardness Scale of about 50 to about 90 and more preferably about 70 . The undermolded area 32 forms the periphery or edges at the top and the leading and trailing edges of the fins. The part forming the undermolded area is then placed in a mold and a composition forming a softer rubber, having a Shore A Hardness Scale of about 30 to about 50, and more preferably about 40, is then overmolded to form the inner sawtooth area 34 to yield a unitary foil, as shown in FIG. 7.

Figure 7:
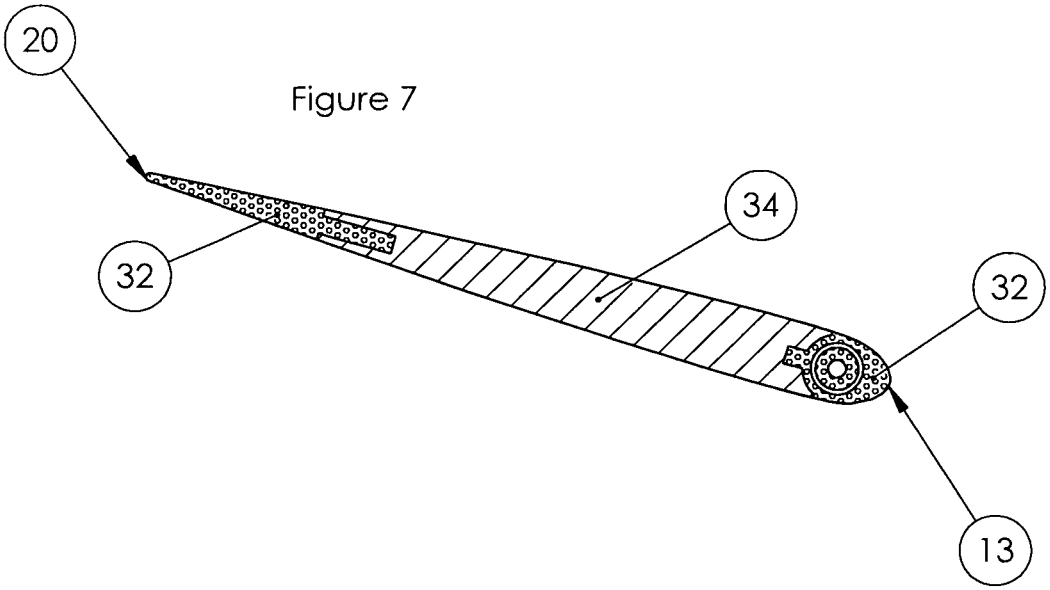
FIG. 7 is a sectional view taken along line 7-7 in FIG. 5.
Figure 8:
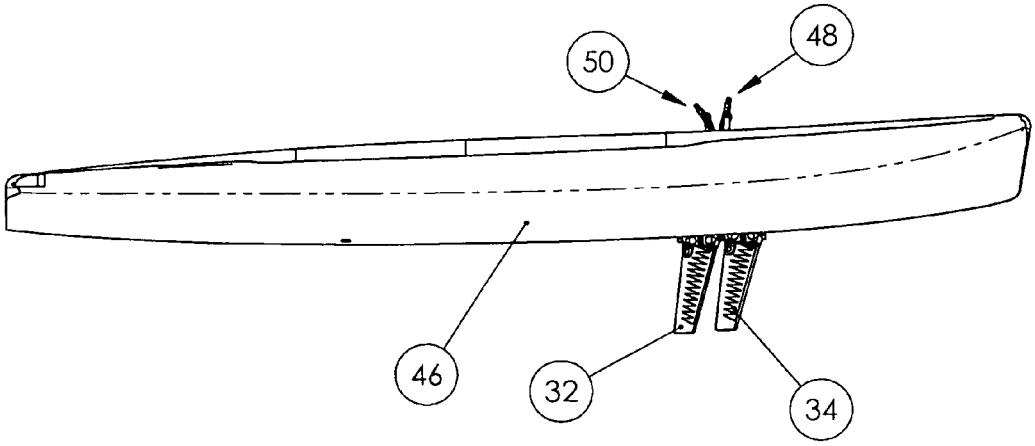
FIG. 8 is a side view of a watercraft of the present invention.
Figure 9:
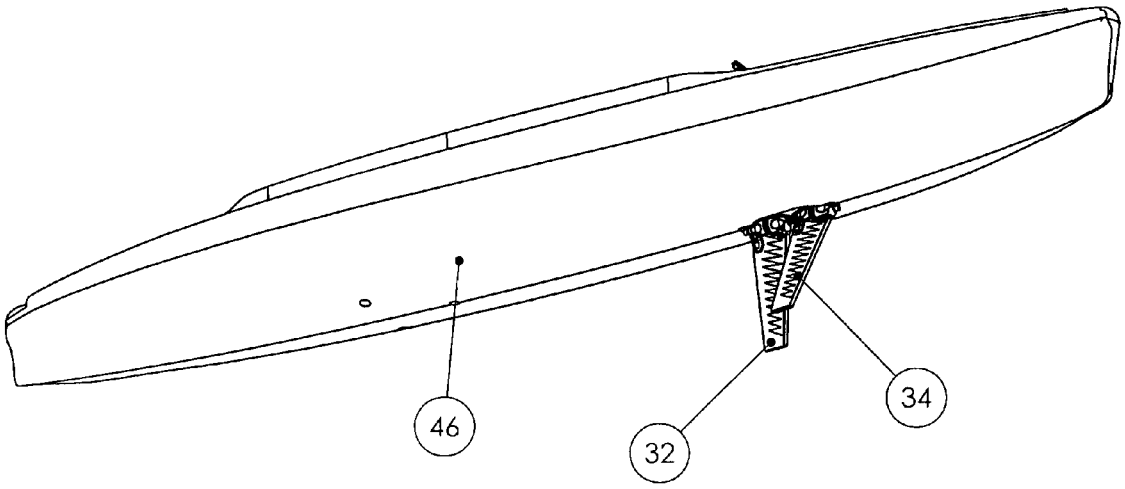
FIG. 9 is perspective view of the watercraft of FIG. 8.
Figure 10:
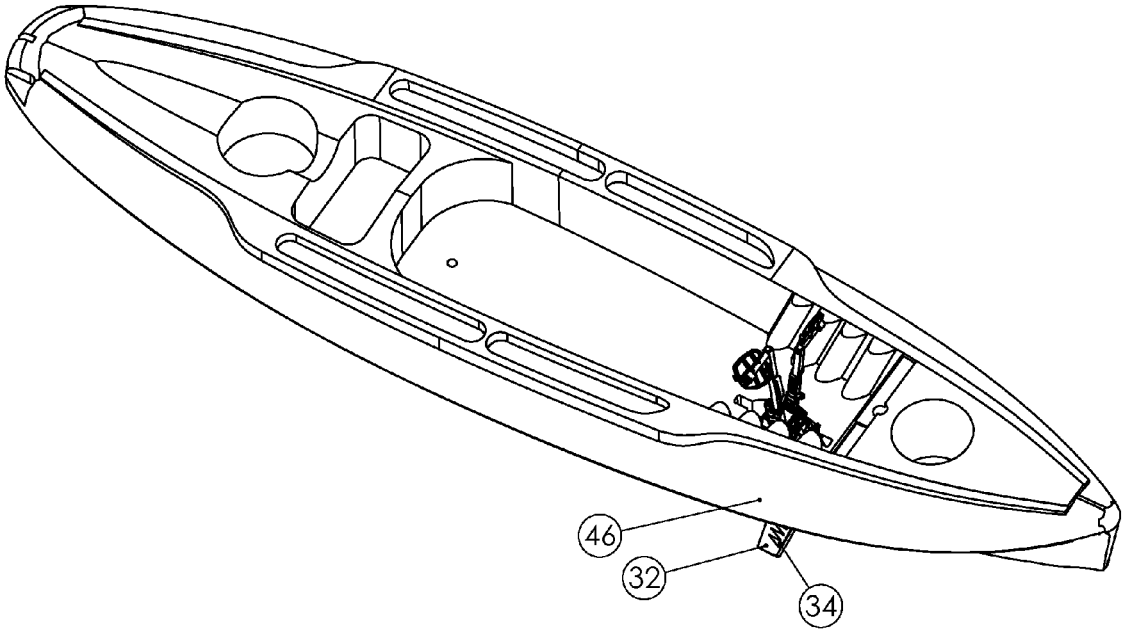
FIG. 10 is a perspective view from above of the watercraft shown in FIGS. 8 and 9.

As shown in FIG. 7, the fin is thicker at the leading edge 13 than at the trailing edge 20. However, there is a relatively large area of stiffer peripheral rubber material 32 as the trailing edge 20 is approached. This provides increasing cordwise stiffness in the fin itself in the direction from leading edge to trailing edge even as the fin becomes gradually thinner. Cordwise stiffness can, if desired, be further increased at the trailing edge by advancing thumb nut 26 on lead screw 26.

The sawtooth configuration of the softer rubber material at 34 is preferred. However, other similar shapes of the softer area can be devised by those skilled in the art to provide the same fin characteristics.

Figure 2:
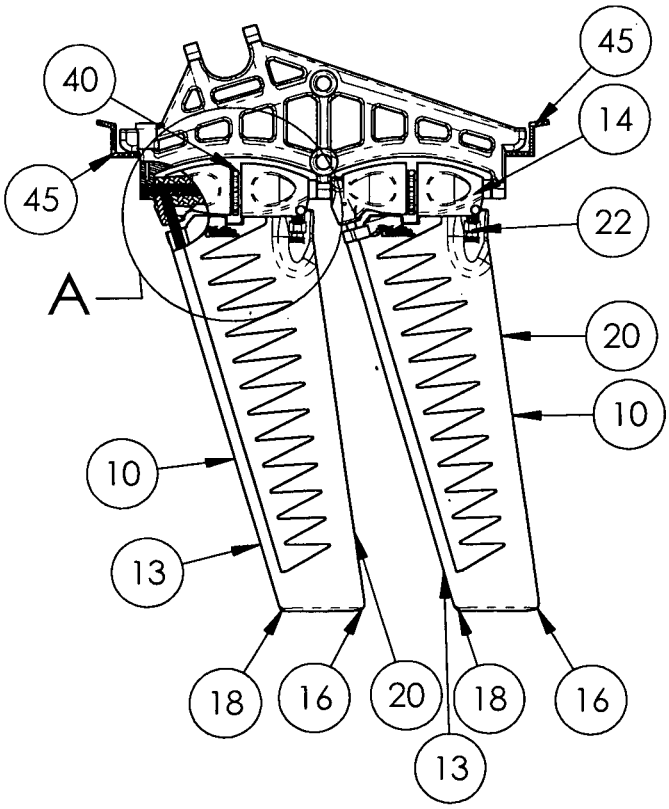
FIG. 2 shows the structure of FIG. 1 (encircled and identified by the letter "A") as well as the complete fin and drive assembly.
Figure 4:
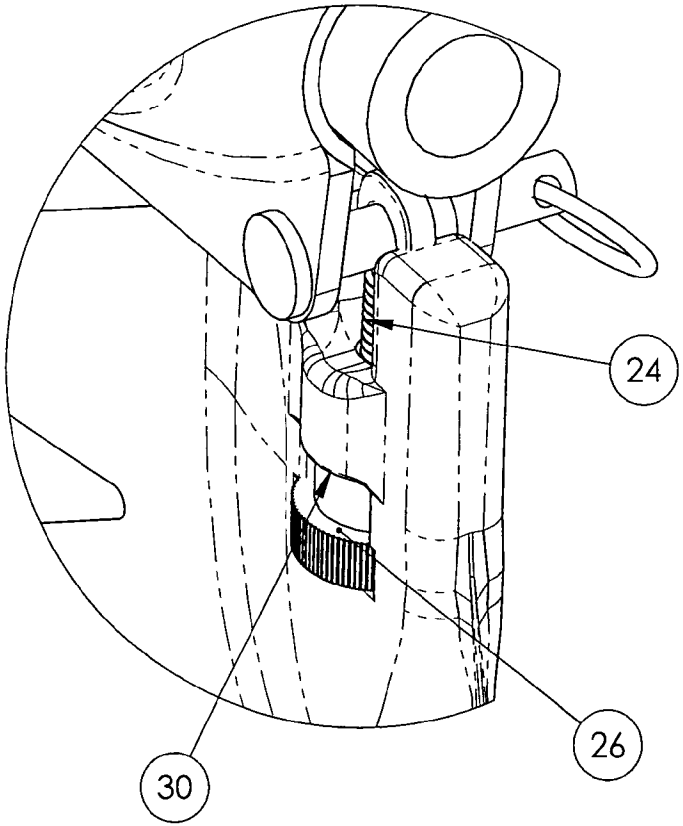
FIG. 4 is an enlargement of the structure within circle "A" in FIG. 3.
Figure 3:
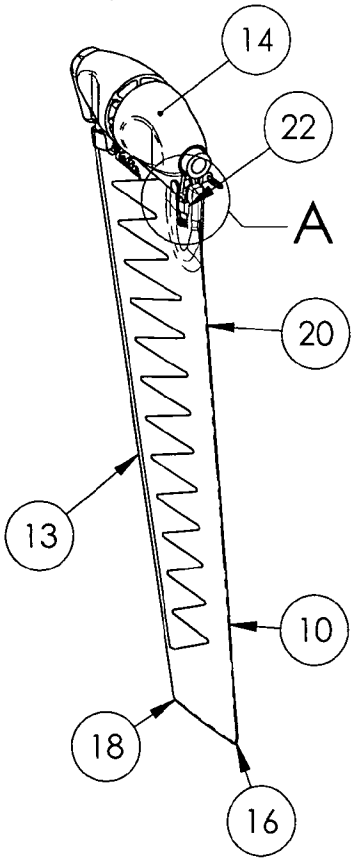
FIG. 3 is a perspective view of one of the fins of this invention.
Figure 5:
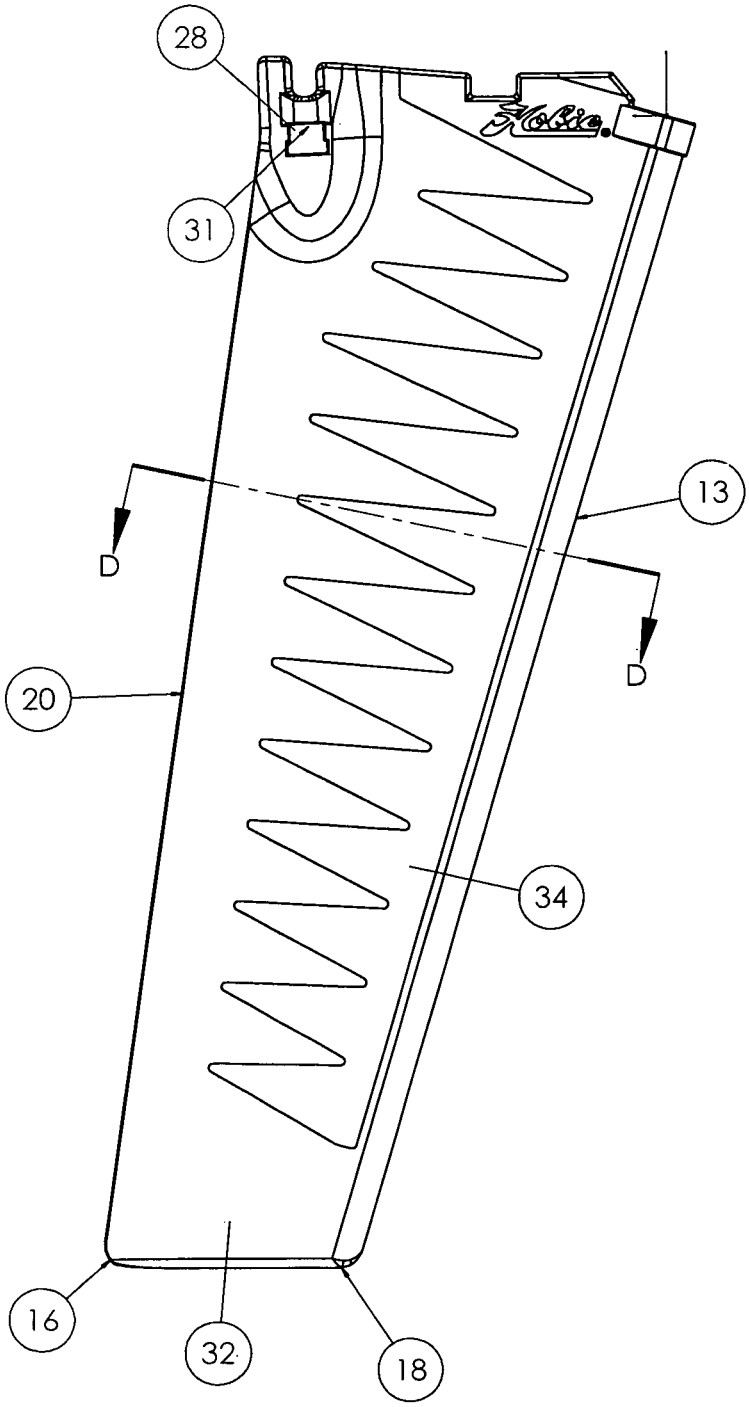
FIG. 5 is a plan view of one of the fins prior to assembly.
Figure 6:
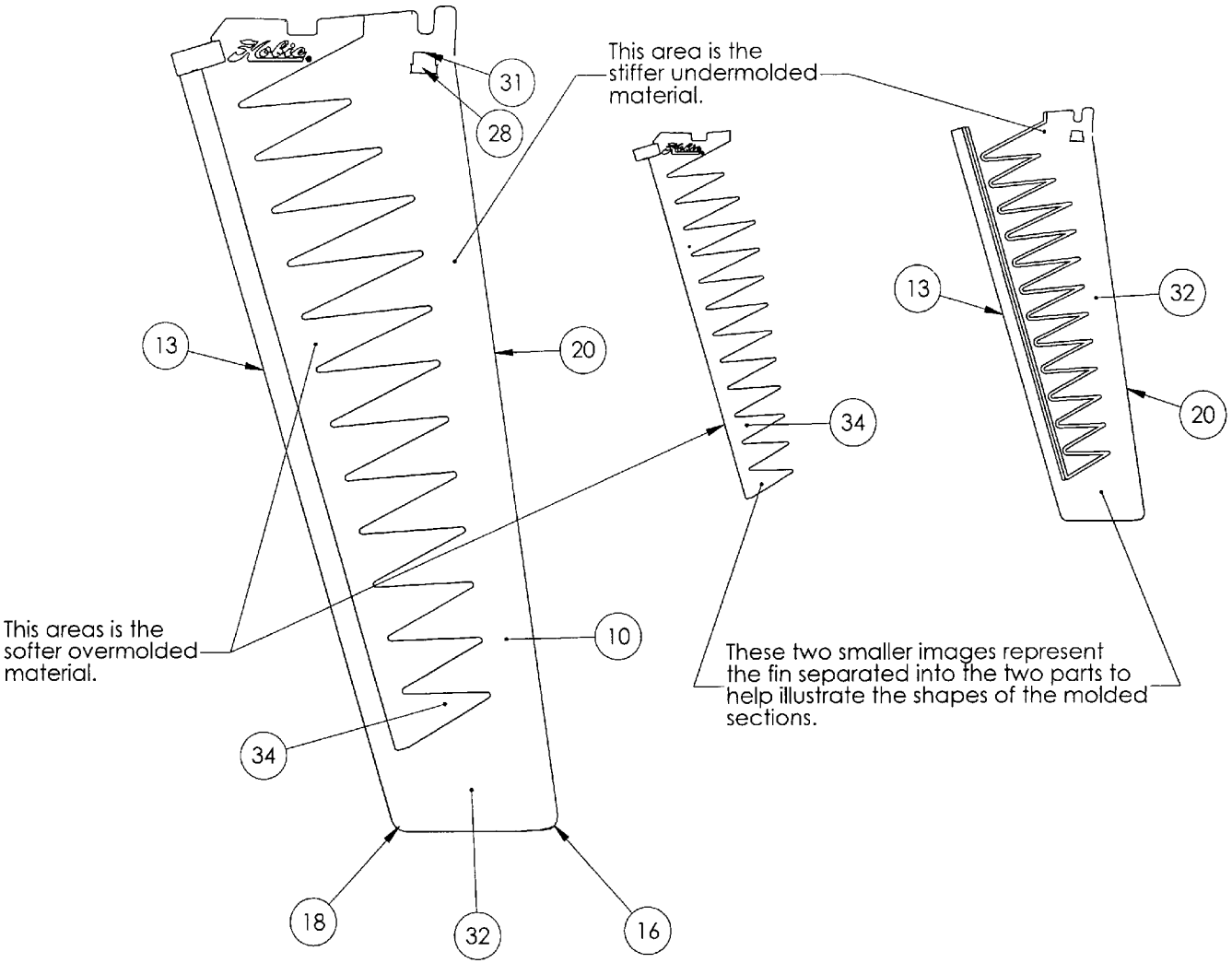
FIG. 6 is an exploded view of the fin showing the stiffer undermolded and soft overmolded areas, separately, and in final assembly.

The base 14 includes inner member 36 having a through hole for receiving the shaft 38 on which the base carrying the fin 10 rotates in oscillating fashion. Integrally formed at the center of the outer surface of inner member 36 is sprocket 40 over which passes a chain (not shown). The entire mechanism shown in the drawings of this patent is received in the bottom of the lower compartment 45 of a kayak 46 and extends downwardly through the opening in the lower compartment 45 into the water as shown in FIG. 2. The chain drives the base with fin 10. The base has attached thereto fairings 42 and 44.

It is to be understood that there are two fins 10, each with its own base, as shown in FIG. 2.

The invention claimed is:

1. A watercraft having propulsion means extending below the water line comprising a pair of flexible fins each having a leading edge, a trailing edge, a top end and a lower end, said fin being adapted to oscillate through an arcuate path in a generally transverse direction across the central longitudinal dimension of said watercraft, and means operatively associated with said propulsion means comprising foot pedals for applying input force to said propulsion means whereby as input force is applied said flexible fins can twist to form an angle of attack for providing forward thrust with respect to the longitudinal dimension of the watercraft while moving in both directions along said arcuate path;

wherein each of said fins is firmly restrained along its leading edge and restrained at its lower end near its trailing edge to provide less restraint at said trailing edge, and each said fin is provided with an essentially square top end to provide enhanced fin twist and more efficient propulsion;

wherein the fin has a generally peripheral area which is harder and less flexible than the inner area whereby the cordwise stiffness of the fin itself increases in the direction of the trailing edge.

2. The watercraft of claim 1 having the improvement wherein each of said fins is provided with means at its trailing edge to provide adjustable tensioning of the trailing edge.

3. The watercraft of claim 1 having the further improvement wherein each of said fins is provided with threaded means at its trailing edge to provide adjustable tensioning of the trailing edge.

4. A watercraft having propulsion means extending below the water line comprising a pair of flexible fins each having a leading edge, a trailing edge, a top end and a lower end, said fin being adapted to oscillate through an arcuate path in a generally transverse direction across the central longitudinal dimension of said watercraft, and means operatively associated with said propulsion means comprising foot pedals for applying input force to said propulsion means whereby as input force is applied said flexible fins can twist to form an angle of attack for providing forward thrust with respect to the longitudinal dimension of the watercraft while moving in both directions along said arcuate path;

wherein each of said fins is firmly restrained along its leading edge and restrained at its lower end near its trailing edge to provide less restraint at said trailing edge, and each said fin is provided with an essentially square top end to provide enhanced fin twist and more efficient propulsion, and said fins are constructed and arranged such that as input force is applied on said foot pedals, the less restrained lower end of the fins twists to assume a propeller shape and, as the fins oscillate, the fins change pitch or shape as they simultaneously reverse direction of movement at the opposite ends of their arcuate path;

wherein the fin has a generally peripheral area which is harder and less flexible than the inner area whereby the cordwise stiffness of the fin itself increases in the direction of the trailing edge.

5. The watercraft of claim 4 having the improvement wherein each of said fins is provided with means at its trailing edge to provide adjustable tensioning of the trailing edge.

6. The watercraft of claim 4 having the further improvement wherein each of said fins is provided with threaded means at its trailing edge to provide adjustable tensioning of the trailing edge.

* * * * *